US006813834B2

(12) United States Patent
Anderson

(10) Patent No.: US 6,813,834 B2
(45) Date of Patent: Nov. 9, 2004

(54) ANGLED SHANK BLADE

(76) Inventor: Martin L. Anderson, 6852 Estes Ave. NW., Maple Lake, MN (US) 55358

( * ) Notice: Subject to any disclaimer, the term of this patent is extended or adjusted under 35 U.S.C. 154(b) by 15 days.

(21) Appl. No.: 10/305,216

(22) Filed: Nov. 26, 2002

(65) Prior Publication Data

US 2004/0098865 A1 May 27, 2004

(51) Int. Cl.[7] ..... B26B 19/00
(52) U.S. Cl. ..... 30/170; 30/357; 299/36.1
(58) Field of Search ..... 30/167, 168, 169, 30/170, 314, 315, 346, 348, 349, 352; 299/36.1, 37.1

(56) References Cited

U.S. PATENT DOCUMENTS 2,874,946 A * 2/1959 Singleterry ..... 299/37.1
3,907,450 A * 9/1975 Cutler ..... 299/36.1
4,549,350 A * 10/1985 Patillo ..... 30/170
4,683,657 A * 8/1987 Anderson et al. ..... 30/170
4,779,301 A * 10/1988 Millette ..... 15/105
6,105,470 A * 8/2000 Hutchins ..... 81/45
6,264,282 B1 * 7/2001 Gaumont ..... 299/36.1
6,328,387 B1 * 12/2001 Cooper et al. ..... 299/39.6
6,343,981 B1 * 2/2002 Buchanan ..... 451/350
6,443,526 B1 * 9/2002 Scarlett ..... 299/37.1

* cited by examiner

*Primary Examiner*—Hwei-Siu Payer
(74) *Attorney, Agent, or Firm*—Nikolai & Mersereau, P.A.

(57) ABSTRACT

An angled shank blade for a carpet or tile stripping machine with a flat blade for engaging the surface of a floor. A shank attached to the blade at an angle for receiving the weight of the floor stripping machine and keeping the blade parallel to the floor. The blade has a carbide insert for long lasting skiving of material from the floor. The carbide tip is easily replaced to keep the leading edge sharp. The carbide insert being held parallel to the floor by the blade such that it cuts at a preferred carbide blade tip angle of about 45 degrees with respect to the surface of the floor.

10 Claims, 1 Drawing Sheet

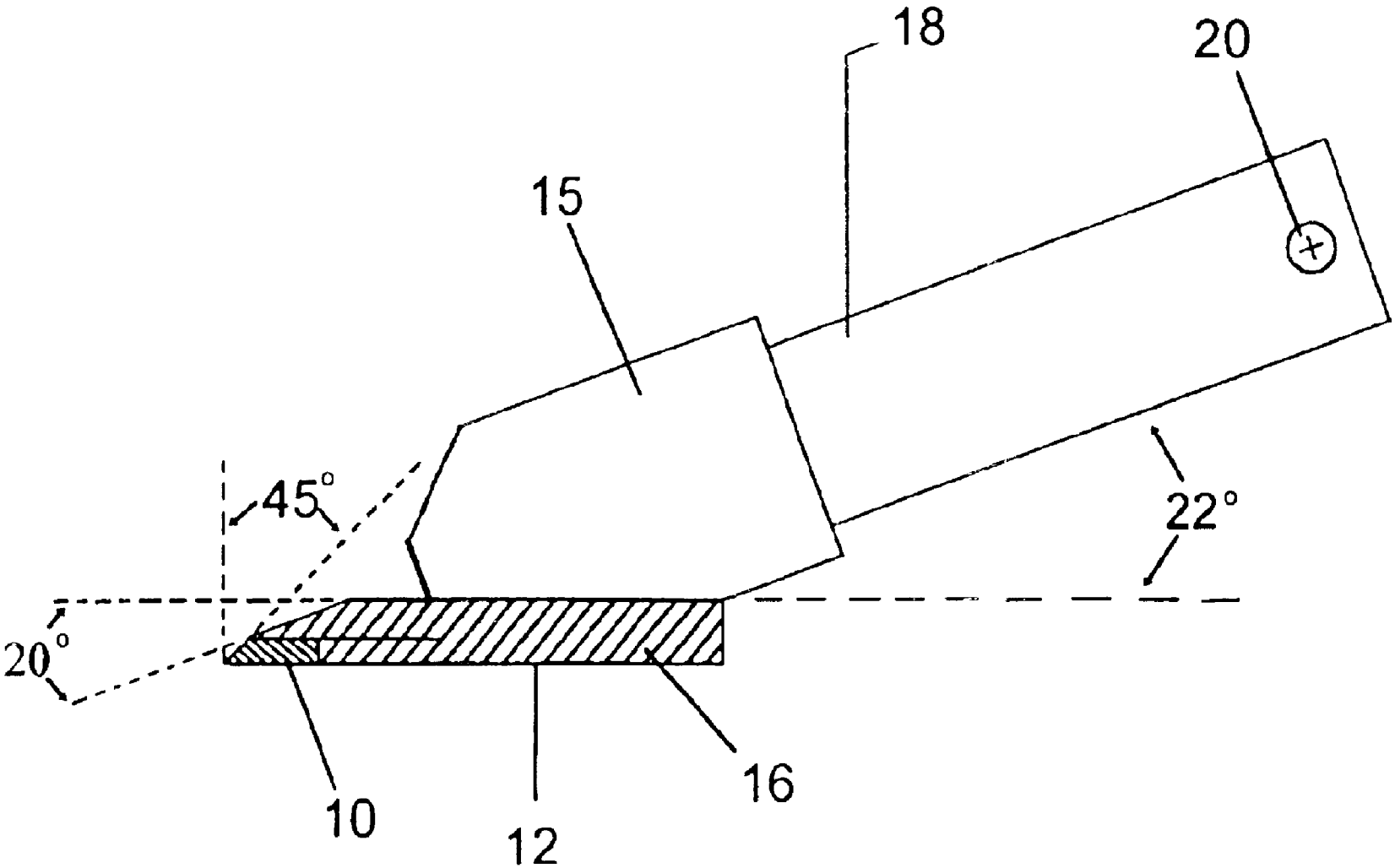
20
18
15
22°
45°
20°
16
12
10

ANGLED SHANK BLADE

BACKGROUND OF THE INVENTION

1. Field of the Invention

This invention relates to blades for carpet and tile floor stripping machines and more particularly to an angled carbide tipped blade.

2. Description of the Related Art

There are many types of floor stripping machines. In one type the blades engaging the floor are angled downward and have a large force pushing down on the blade so that it engages the floor at an angle and strips the ceramic tiles, carpet, tile, adhesives and other material from the floor. The blade tips dull quickly and have to be changed frequently.

Another type of floor stripping machine has a blade resting on the floor like a plow with a pushing force applied behind the blade parallel to the floor. However it is difficult to keep the blade flat on the floor and the blade will ride up over the material to be stripped.

SUMMARY OF THE INVENTION

The angled stripper blade has a shoe portion for riding on the floor and having the weight of the machine on it for engaging the floor. A blade on the front portion of the shoe is held parallel to the floor for skiving the ceramic tiles, carpet, tile, adhesive or other material from the floor surface. The blade angle relative to the floor is optimized for stripping the floor. The carbide tip on the shoe is stronger and last longer than a metal blade and can be changed easily when the tip gets dull.

OBJECTS OF THE INVENTION

It is an object of the invention to quickly and easily strip a floor of ceramic tiles, carpet, tile, adhesives and other materials.

It is an object of the invention to provide a blade tip, which lasts longer without becoming dull.

It is an object of the invention to provide a stripper blade, which is easy to change.

It is an object of the invention to provide an angled blade with weight on the blade to keep the blade parallel to the floor.

It is an object of the invention to hold the blade at an optimal angle to strip the floor.

Other objects, advantages and novel features of the present invention will become apparent from the following description of the preferred embodiments when considered in conjunction with the accompanying drawings.

BRIEF DESCRIPTION OF THE DRAWINGS

The FIGURE is a side view of the angled blade shank.

DESCRIPTION OF THE PREFERRED EMBODIMENTS

The FIGURE shows a blade 16 having a carbide insert 10 for engaging ceramic tiles or other material to be removed from a floor. The blade 16 has a flat bottom portion 12 for riding on the floor and holding the blade parallel to the surface of the floor. The head of the blade 15 is attached to the top of blade 16 and has a shank 18 attached at an angle which is on the order of 22 degrees from the floor such that the weight of the stripper machine can be used to push down on the blade 12 and keep the blade on the floor such that the carbide insert 10 can skive the unwanted material from the floor.

The shank 18 has an aperture 20 for attaching the shank to the stripper machine such that the weight of the machine rests on the surface 12 of blade 16. The angle of the shank 18 in the FIGURE is 22 degrees which is favorable for extending the blade out in front of the machine while placing the weight of the stripper machine on the back portion of the blade 16. The front portion of the blade 16 with the carbide insert 10 has the weight of the machine behind it for pushing on the material to be removed.

The carbide insert 10 has a tip angled at 45 degrees which has been found to be an angle which is efficient for skiving material from floors. The blade angle above the insert is 20 degrees to allow the material scraped from the floor to be lifted up easily.

The blade 16 can be of any width. The narrower the blade width the easier it is to push along the floor to skive material therefore but then more passes need to be made to remove all the material from the floor.

Although the carbide inset is shown with a cutting angle of 45 degrees other angles may be used depending on the type of material to be removed from the floor. Similarly the 20 degree angle on the top of the blade 16 can be changed to fit the job to be accomplished.

The shank 18 angle of 22 degrees can also be varied depending on the design and weight of the stripper machine and the flooring to be stripped.

Obviously, many modifications and variations of the present invention are possible in light of the above teachings. It is therefore to be understood that, within the scope of the appended claims, the invention may be practiced otherwise than as specifically described.

What is claimed is:

1. A floor stripping blade comprising:

a blade portion having a flat bottom surface, a carbide insert attached to the blade portion, the carbide insert has a leading cutting edge with an angle of approximately 45 degrees with respect to the surface of the floor for efficiently skiving material from the floor, a blade head attached to the blade portion, a blade shank attached to the blade head for connecting the floor stripping blade to a floor stripping machine at an angle such that the weight of the floor stripping machine rests on the flat bottom surface of the blade portion resting on the floor in front of the floor stripping machine.

2. A floor stripping blade as in claim 1 wherein:

the shank is angled at approximately 22 degrees with respect to the floor.

3. A floor stripping blade as in claim 1 wherein:

the blade portion has an angle of approximately 20 degrees adjacent the carbide insert for removing material skived by the carbide insert.

4. A floor stripping blade as in claim 1 wherein:

the blade portion head is on the rear portion of the blade.

5. A floor stripping blade as in claim 1 wherein:

the carbide insert is on the front portion of the blade portion.

6. A floor stripping blade comprising:

a blade portion having a flat bottom surface, a carbide insert attached to the blade portion, a blade head attached to the blade portion, the blade portion has an angle of approximately 20 degrees adjacent the carbide insert for removing material skived by the carbide insert, a blade shank attached to the blade head for connecting the floor stripping blade to a floor stripping machine at an angle such that the weight of the floor stripping machine rests on the flat bottom surface of the blade portion resting on the floor in front of the floor stripping machine.

7. A floor stripping blade as in claim 6 wherein:

the carbide insert has a leading cutting edge with an angle of approximately 45 degrees with respect to the surface of the floor for efficiently skiving material from the floor.

8. A floor stripping blade as in claim 6 wherein:

the shank is angled at approximately 22 degrees with respect to the floor.

9. A floor stripping blade as in claim 6 wherein:

the blade head is on the rear portion of the blade portion.

10. A floor stripping blade as in claim 6 wherein:

the carbide insert is on the front portion of the blade portion.

* * * * *

UNITED STATES PATENT AND TRADEMARK OFFICE

CERTIFICATE OF CORRECTION

PATENT NO. : 6,813,834 B2
APPLICATION NO. : 10/305216
DATED : November 9, 2004
INVENTOR(S) : Martin L. Anderson It is certified that error appears in the above-identified patent and that said Letters Patent is hereby corrected as shown below:

Claim 4, line 2, should read as follows -- the blade head is on a rear portion of the blade portion. --

Signed and Sealed this
Thirteenth Day of November, 2012

David J. Kappos

David J. Kappos
*Director of the United States Patent and Trademark Office*

UNITED STATES PATENT AND TRADEMARK OFFICE

CERTIFICATE OF CORRECTION

PATENT NO. : 6,813,834 B2
APPLICATION NO. : 10/305216
DATED : November 9, 2004
INVENTOR(S) : Martin L. Anderson It is certified that error appears in the above-identified patent and that said Letters Patent is hereby corrected as shown below:

Column 2, line 64 (Claim 4, line 2) should read as follows -- the blade head is on a rear portion of the blade portion. --

This certificate supersedes the Certificate of Correction issued November 13, 2012.

Signed and Sealed this
Eleventh Day of December, 2012

David J. Kappos

David J. Kappos
*Director of the United States Patent and Trademark Office*